US005207535A

United States Patent [19]

Saab

[11] Patent Number: 5,207,535

[45] Date of Patent: May 4, 1993

[54] PUSH-ON GRIPPER PLATE FOR USE WITH ROCK BOLTS

[76] Inventor: Thomas L. Saab, 1390 Hazelton Blvd., Burlington, Ontario, Canada, L7P 4V3

[21] Appl. No.: 785,115

[22] Filed: Oct. 30, 1991

[51] Int. Cl.[5] ..... E21D 11/00; E21D 21/00

[52] U.S. Cl. ..... 405/269.1; 405/288; 411/533

[58] Field of Search ..... 405/302.3, 288, 259.1; 411/437, 526, 527, 512, 533

[56] References Cited

U.S. PATENT DOCUMENTS

| | | | |
|---|---|---|---|
| 2,342,910 | 2/1944 | Tinnerman | 411/525 X |
| 4,740,111 | 4/1988 | Gagnon | 405/302.3 X |
| 4,784,418 | 11/1988 | Pearson et al. | 411/525 X |
| 4,911,594 | 3/1990 | Fisher | 411/437 |

*Primary Examiner*—Dennis L. Taylor
*Attorney, Agent, or Firm*—Patrick J. Hofbauer

[57] ABSTRACT

A push-on gripper plate for use in securement of a mesh screening means on the protruding, threaded, end portion of a rock bolt inserted into a rock face is disclosed. The gripper plate has a generally planar base portion adapted to overlie the mesh screening means and a central opening in the base portion having two or more leg portions positioned on the perimeter of the opening and inclined upwardly, inwardly toward the center of said opening above the plane of the base portion. A plurality of tab portions are positioned on the perimeter of said opening in alternating arrangement with said leg portions, the tab portions being inclined upwardly, inwardly toward the center of the central opening above the plane defined by the base portion.

11 Claims, 2 Drawing Sheets

PUSH-ON GRIPPER PLATE FOR USE WITH ROCK BOLTS

FIELD OF THE INVENTION

The present invention relates to gripper plates, and more particularly to a push-on gripper plates for securing a mesh screening means onto the protruding end of rock bolts, such as are used in mine wall and roof stabilization.

BACKGROUND OF THE INVENTION

It is well known in the mining and shoring arts to utilize rock bolts to secure a wire mesh over the rock face of a mine roof or wall so as to stabilize the rock face and reduce the risk of injury to mine personnel by way of falling rock. Similar mesh screening means are sometimes used in excavation and shoring operations where rock or shale faces may be exposed. In both types of such operations, a suitably sized hole is drilled into the rock or shale material generally perpendicular to its face, and the rock bolt is inserted into the hole to a depth at which its threaded free end protrudes beyond the rock face by several inches. The rock bolts are retained in the drilled holes by any conventional means, and such retention means, together with the rock bolts themselves are well-known and are not part of the present invention.

After insertion of the rock bolt into a pre-drilled hole, a retention plate having a centrally positioned hole is typically placed over the protruding free end portion of the rock bolt and a conventional washer and nut are threaded onto this free end to hold fast the retention plate against the rock face and thereby stabilize the rock bolt within the rock material. Conventional forms of retention plates are readily available for this purpose, and examples thereof can be seen in U.S. Pat. Nos. 3,090,203 (Durget) and 4,740,111 (Gagnon), the teachings of which patents are hereby incorporated by reference. Once the rock bolts are installed in this manner, the wire mesh can be applied over the rock face and held thereagainst by means of secondary fastening means. Such secondary fastening means may be applied to the rock face independently of the rock bolts, or more efficiently, by attachment to the protruding free end of the rock bolts. The present invention is concerned with the provision of an improved secondary attachment means of the latter type.

The mesh screening means used is typically a wire mesh screening means, although other materials can be used. The size of the openings in the mesh screening means is larger than the diameter of the rock bolts, so that the rock bolts can pass freely therethrough. Of course, the mesh openings are sufficiently small to prevent large pieces of the rock face from breaking loose and passing through the installed mesh.

SUMMARY OF THE INVENTION

The present invention relates to a push-on gripper plate for use in securement of a mesh screening means on the protruding, threaded, free end of a rock bolt inserted into a rock face, wherein the gripper plate comprises a generally planar base portion adapted to overlie the mesh screening means. A central opening is provided in the base portion having two or more leg portions positioned on the perimeter of the opening, the leg portions being inclined downwardly, inwardly toward the centre of the opening below the plane of the base portion. A plurality of tab portions are also positioned on the perimeter of the opening in alternating arrangement with the leg portions, the tab portions being inclined downwardly, inwardly toward the centre of the opening below the plane defined by the base portion. The inclination angle of the tab portions is preferably steeper than the inclination angle of the leg portions. With this arrangement, the leg portions are dimensioned and otherwise adapted to frictionally engage therebetween the threaded end of the rock bolt to hold the gripper plate on the end of the rock bolt over the mesh screening means. Moreover, the tab portions are dimensioned and otherwise adapted to together provide a gripping surface for overlying engagement by a socket or other type of wrench, so as to allow the wrench to be used for pushing the gripper plate on to the free end of the rock bolt, and/or for screw tightening thereof during installation, should this be necessary.

The gripper plate described is simpler to manufacture and less expensive than previously known gripper plates. It will be appreciated that both the leg and the tab portions can be die punched in a single punch operation from the material surrounding the perimeter of the opening. Not only does this make the punching dies simpler and cheaper to construct, but there is no material waste in the production of the gripper plate.

Other prior art gripper plates, such as that disclosed in U.S. Pat. No. 4,740,111 (Gagnon), have side flanges around the outer perimeter, which side flanges require considerably more material to construct, at substantially increased cost. Also, such side flanges, or other protruding tabs spaced from the central opening make packaging, handling and shipping of the gripper plates more difficult, as tight nesting of the prior art plates is not easily achievable.

It should also be appreciated with the gripper plate of the present invention, that the folding back of the tab portions away from the edge of the central opening give a greater freedom of choice in the angling and dimensioning of the leg portions of the gripper plate, which factors are highly critical to the yield strength of the gripper plate. Moreover, such freedom of choice allows the leg portions to be freely dimensioned and angled to accommodate a wide range of rock bolt diameters and thread patterns. In a preferred embodiment of gripper plate according to the invention, each of the leg porions extending from the perimeter of the central opening has a different inclination angle, such that each leg portion contacts the rock bolt thread at a different angle. This difference in contact angle can be tailored to a specific thread pattern, so as to dramatically increase the gripping strength of the gripper plate, to the extent that loads in excess of the failure loads of the screening means can be achieved. As such, the gripper plate ceases to be the weakest link in the support system, as has been the case with prior art gripper plates. These and other advantages of the novel gripper plate disclosed herein will become more apparent from the detailed description of a preferred embodiment of the invention which follows immediately below.

DETAILED DESCRIPTION OF A PREFERRED EMBODIMENT

Introduction to the Drawings

Figure 1:
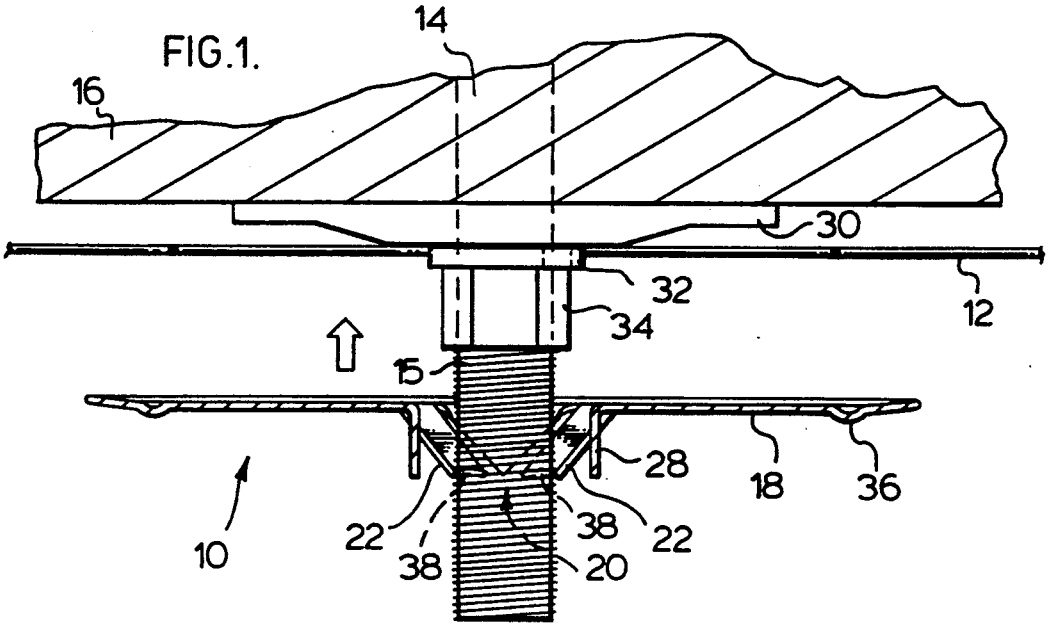
Figure 2:
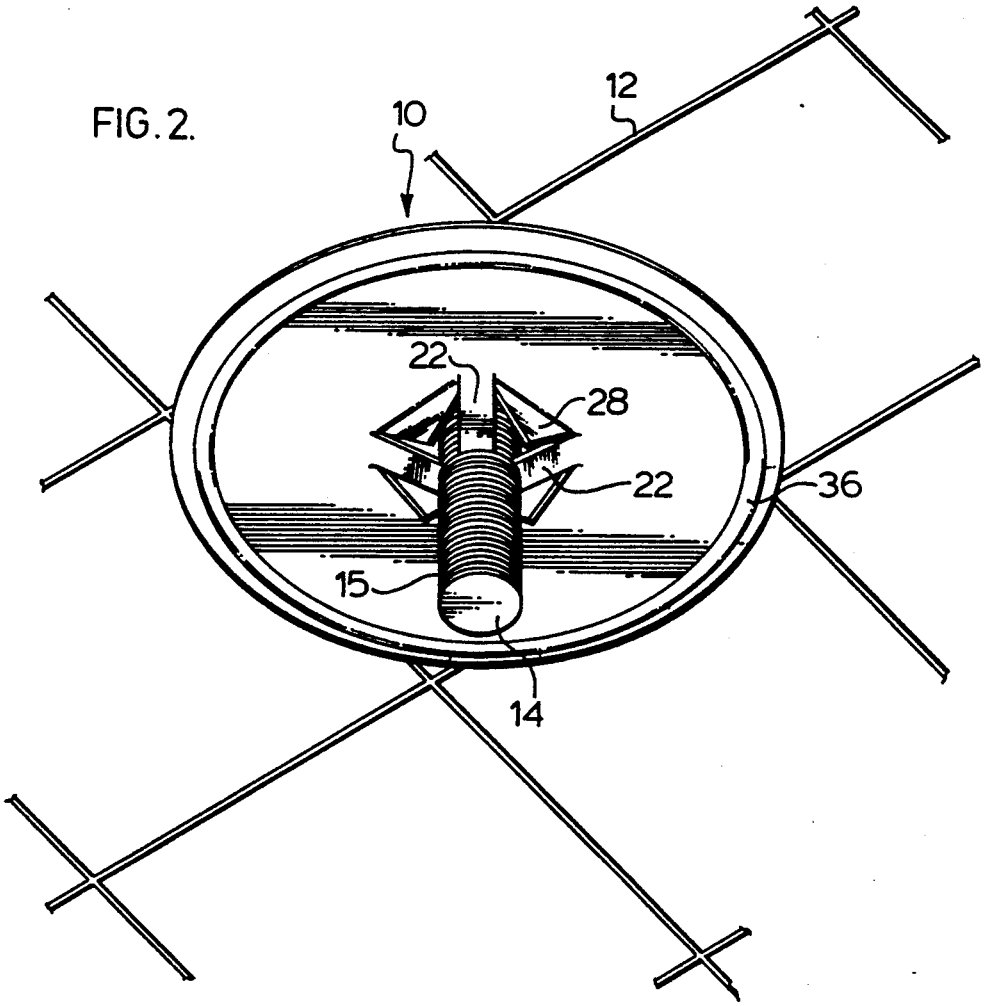
Figure 3:
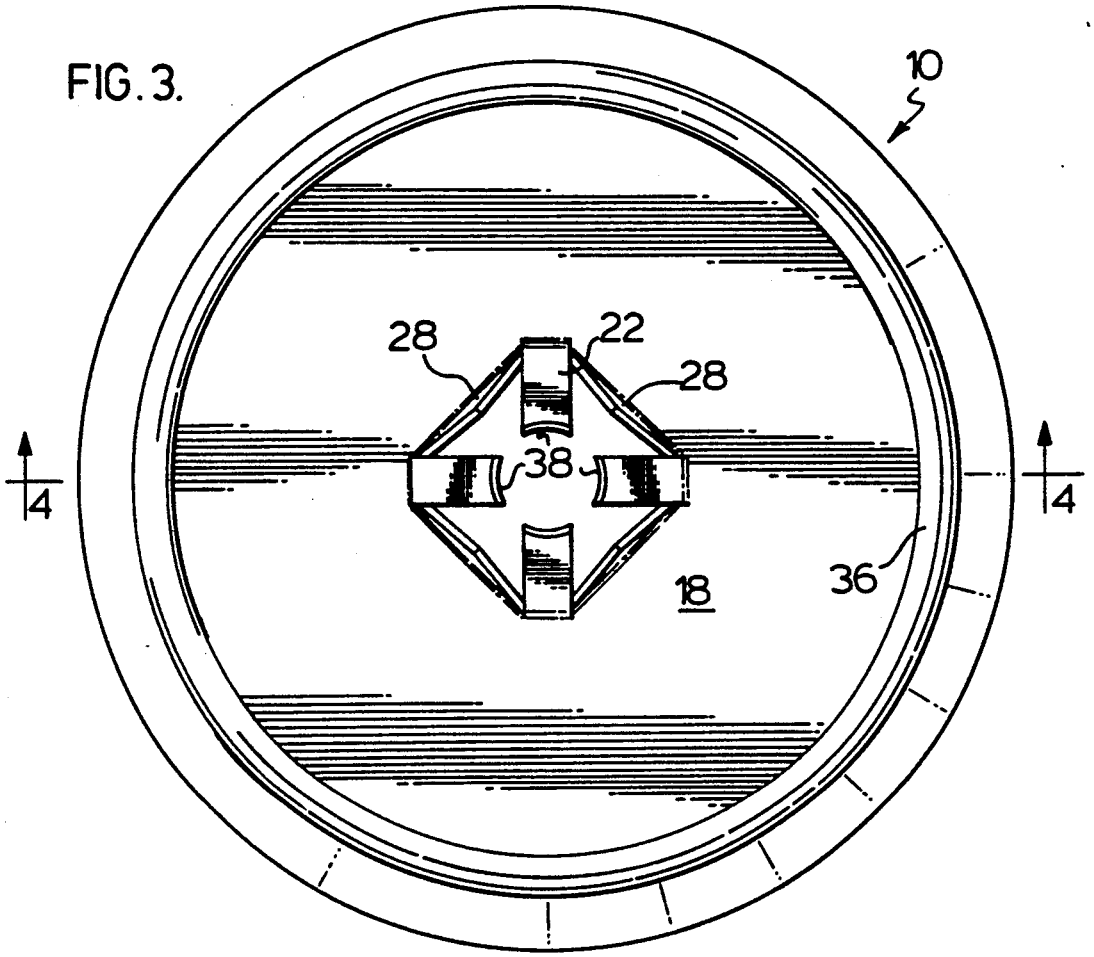
Figure 4:
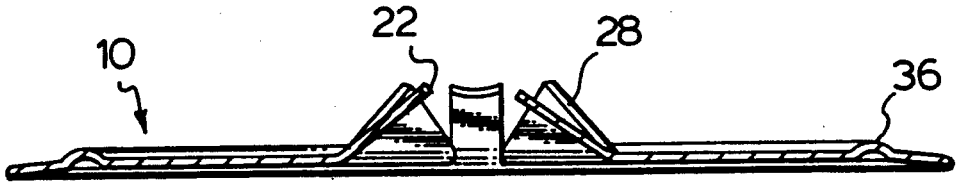

FIG. 1 of the drawings appended hereto is a schematic view illustrating installation of a wire mesh screening means onto the end of a rock bolt utilizing a gripper plate according to the invention;

FIG. 2 of the drawings is a perspective view of the gripper plate and rock bolt of FIG. 1;

FIG. 3 of the drawings is a top plan view of the gripper plate of FIGS. 1 and 2; and, FIG. 4 is a sectional view of the gripper plate of FIGS. 1, 2, and 3, taken along line 4—4 of FIG. 3.

Referring now to the drawings, there will be seen a push-on gripper plate 10 for use in securement of a mesh screening means 12 on the protruding, threaded, end portion 15 of a rock bolt 14 inserted into a rock face 16. The rock bolt 14 is of well-known construction, and is inserted into a drilled hole (not shown) in the rock face 16, so that the threaded portion 15 protrudes several inches beyond the rock face. After such insertion, but prior to installing the gripper plate 10, a conventional retention plate 30 is placed over the threaded portion 15 of the rock bolt 14, followed by a conventional washer 32. A conventional nut 34 is then tightened against the retention plate 30, so as to hold the retention plate 30 against the rock face 16, and thereby anchor the rock bolt 14. Once the rock bolt 14 is installed in this manner, a conventional wire mesh screening means 12 is placed over the protruding threaded end portion 15 of the rock bolt 14, with the threaded end 14 passing through a hole in the screening means 12. The gripper plate 10 is then pushed over the threaded end portion 15, either by hand, or, if necessary, with the aid of a socket or similar type of wrench (not shown) in a manner more fully described below.

The gripper plate 10 comprises a generally planar base portion 18 adapted to overlie the mesh screening means 12. A central opening 20 in the base portion 18 has four leg portions 22 positioned on the perimeter of the central opening 20, each of the leg portions being inclined, in use, downwardly, inwardly toward the centre of the opening 20 above the plane of the base portion, as best seen in FIG. 1. The inclination angle of the leg portions 22 is nominally 45 degrees from the plane defined by the base portion 18, but each of such leg portions may be several degrees greater or less than 45 degrees. In fact, it is preferable that the inclination angle of the four leg portions 22 not be equal, so as to enhance retention of the gripper plate 10 on the screw threads of the threaded portion 15 of the rock bolt 14. The exact inclination angle of each leg portion 22 can be routinely calculated in respect of each leg portion 22, with specific reference to the size of the central opening 20, the diameter of the threaded end portion 15 and the dimensions and angling of the particular thread pattern used on the end portion 15. The object of such calculations is to angle the leg portions 22 to generally mimic the thread pattern of the nut 34, (which thread pattern is complementary to that of the threaded end portion 15) so as to maximize the axial load bearing characteristics of the gripper plate 10, while at the same time allowing the gripper plate 109 to be pushed on to the protruding end 15 of the rock bolt 14 without the absolute need of full threading. The free ends 38 of the leg portions 22 are preferably concavely curved (see especially FIG. 4) so as to more firmly nest in engaged relation between the individual threads of the threaded end portion 15 (see especially FIG. 2).

Four tab portions 28 are also positioned on the perimeter of the central opening 20 in equidistantly spaced relation from one another, the tab portions 28 being preferentially angled at substantially 90 degrees relative to the plane defined by the base portion 18, so as to facilitate their being frictionally engaged by the inside diameter of a socket wrench for ease of installation. In such instance, the gripper plate 10 is simply placed on the end of the socket wrench (not shown) with the four tab portions inserted into the socket wrench. Then, the gripper plate is pushed over the threaded free end 15 of the rock bolt 14, until the base portion 18 contacts the nut 34 or the wire screening means 12, whereupon final tightening of the gripper plate 10 by means of the socket wrench can be achieved. Of course, such rotary tightening can be utilized at any point of travel of the gripper plate 10 along the threaded end portion 15, should the leg portions 22 bind with the threading on the rock bolt 14. Moreover, removal of the gripper plate 10 through use of a socket or similar wrench is facilitated by the presence of the tab portions 28.

As illustrated, it is preferred to have four leg portions 22 and four tab portions 28 positioned on the central opening in alternating fashion, each of the leg 22 and tab 28 portions being equidistantly spaced around said opening. With the tab portions 28 pulled downwardly to an inclination angle of substantially 90 degrees, this arrangement provides for maximum flexibility in design of the leg portions 22.

A raised boss 36 of circular plan outline is preferably provided on the lower surface (as seen in FIG. 1) of the base portion 18 of the gripper plate 10 adjacent to the outer perimeter of the base portion 18. This boss 36 adds riqidity to the base portion 18.

During installation, the friction plate 10 is pushed on to the rock bolt 14 to secure the mesh screening means 18 between a standard retention plate 30 and the rock face 16, as shown in FIG. 1. A socket or similar wrench (not shown) may be used in the installation to assist in pushing on or tightening of the gripper plate, but this is not necessary in most applications. The installation operation is simpler than with prior art gripper plates, and may be done by hand without the use of jacklegs or stoppers in a minimum period of time.

Preliminary pull tests were done on steel gripper plates as illustrated constructed of C1050 spring steel, hardened and tempered to a Rockwell "C" scale hardness of RC 32 to 40, with an average hardness of RC 38. The thickness of the plate metal was 0.060 inches, and the outside diameter was 5 inches. The threaded section of a ⅝" O.D. rock bolt was inserted into the tensioner and the gripper plate was installed on the rock bolt as previously described. Loads were then applied to the gripper plates in three different modes as follows: a) directly to the hub of the plates; b) as an annulus 2" from the hub of the plates; and, c) as an annulus 4" from the hub of the plate. In the hub loading mode a), average loading at failure was 3.75 tons. In the 2" annulus loading mode b), average loading at failure was 2.5 tons, and in the 4" annulus loading, the average loading at failure was 2.2 tons.

Similar test conducted on the gripper plates using a ¾" O.D. rock bolt resulted in average failure loads of 2.8 tons.

Failure during testing was gradual, on a thread by thread basis, with the gripper plates tending to slide down the rock bolt a thread at a time. Unlike the prior art gripper plates, including the plate disclosed in U.S. Pat. No. 4,740,111, the threads of the rock bolts were not damaged after failure. Moreover, the gripper plates tested could, after failure, still be re-installed on the rock bolt by hand, and after such re-installation still carried an average residual load of almost 1 ton for the ⅝ inch bolts and 1 ton for the ¾ inch bolts. These factors combine to provide a better chance than with known gripper plates to contain the mesh screening means following an instantaneous loading situation. Moreover, these tests indicate consistent failure loads in excess of the failure loads of most mesh screening means used in mining operations, thus confirming that the subject gripper plates are not the weak link in the supplementary support system described herein.

Although this invention has been disclosed with reference to a particular preferred embodiment as shown and described, it is to be understood that it is not to be limited to such embodiment and that other alternatives are envisaged within the scope of the following claims.

I claim:

1. A push-on gripper plate for use in securement of a mesh screening means on the protruding, threaded, end portion of a rock bolt inserted into a rock face, said gripper plate comprising:

a generally planar base portion adapted to overlie the mesh screening means;

a central opening in the base portion having two or more leg portions positioned on the perimeter of said opening and inclined downwardly, inwardly toward the centre of said opening below the plane of the base portion;

a plurality of tab portions positioned on the perimeter of said opening in alternating arrangement with said leg portions, the tab portions being inclined downwardly, inwardly toward the centre of said opening below the plane defined by the base portion;

wherein the leg portions are dimensioned and otherwise adapted to frictionally engage therebetween the threaded end of the rock bolt to hold the gripper plate on the end of the rock bolt over the mesh screening means.

2. A gripper plate according to claim 1, wherein the inclination angle of tab portions is steeper than the inclination angle of the leg portions.

3. A gripper plate according to claim 2, wherein the inclination angle of each of the leg portions is not equal.

4. A gripper plate according to claim 3, wherein the unequal inclination angles of the leg portions are each selected so as to cause the leg portions to substantially duplicate a thread pattern complimentary to that of the threaded end portion of the rock bolt.

5. A gripper plate according to claim 4, wherein the free ends of the leg portions are concavely curved.

6. A gripper plate according to claim 5, wherein the inclination angle of the tab portions is substantially 90 degrees relative to the plane defined by the base portion.

7. A gripper plate according to claim 6, wherein four leg portions are positioned in equidistantly spaced relation around the perimeter of the central opening.

8. A gripper plate according to claim 7, wherein four tab portions are provided in equidistantly spaced relation around the perimeter of the central opening.

9. A gripper plate according to claim 8, wherein the gripper plate is of generally circular plan outline.

10. A gripper plate according to claim 9, wherein a raised boss of circular plane outline is positioned on the lower surface of the base portion adjacent the outer perimeter of said portion.

11. A gripper plate according to claim 10 constructed of hardened, spring steel.

* * * * *